US006465093B2

(12) United States Patent
Csonka

(10) Patent No.: US 6,465,093 B2
(45) Date of Patent: Oct. 15, 2002

(54) METHOD AND APPARATUS FOR THE PRODUCTION OF INDUSTRIAL FILAMENT YARNS BY SWIRLING AND A POLYESTER FILAMENT YARN

(75) Inventor: Istvan Csonka, Lucerne (CH)

(73) Assignee: Rhodia Filtec AG, Emmenbruecke (CH)

( * ) Notice: Subject to any disclaimer, the term of this patent is extended or adjusted under 35 U.S.C. 154(b) by 0 days.

(21) Appl. No.: 09/989,949

(22) Filed: Nov. 20, 2001

(65) Prior Publication Data

US 2002/0101011 A1 Aug. 1, 2002

Related U.S. Application Data

(62) Division of application No. 09/463,936, filed on Feb. 2, 2000, now Pat. No. 6,340,525.

(30) Foreign Application Priority Data

Aug. 6, 1997 (CH) ..... 1851/97

(51) Int. Cl.[7] ..... D01F 6/00

(52) U.S. Cl. ..... 428/364; 428/395

(58) Field of Search ..... 428/364, 395

(56) References Cited

U.S. PATENT DOCUMENTS 6,340,525 B1 * 1/2002 Akamatsu et al. ..... 428/364
6,365,091 B1 * 4/2002 Csonka ..... 264/555

FOREIGN PATENT DOCUMENTS

EP WO99/07930 * 2/1999

* cited by examiner

*Primary Examiner*—Newton Edwards
(74) *Attorney, Agent, or Firm*—Michael J. Striker

(57) ABSTRACT

In a method for the production of industrial filament yarns, by swirling a polyester multifilament at increased temperature, under a thread traction force of less than 140 cN, in an air-loaded swirl nozzle consisting of a nozzle body with a perforated plate and a baffle plate, the heat is directly transmitted to the polyester multifilament and the air is directly transmitted, via the nozzle body, to a highly heat-conductive metal block which is connected directly to the baffle plate and in which a bore is provided for receiving a heating body.

1 Claim, 1 Drawing Sheet

Figure 1:
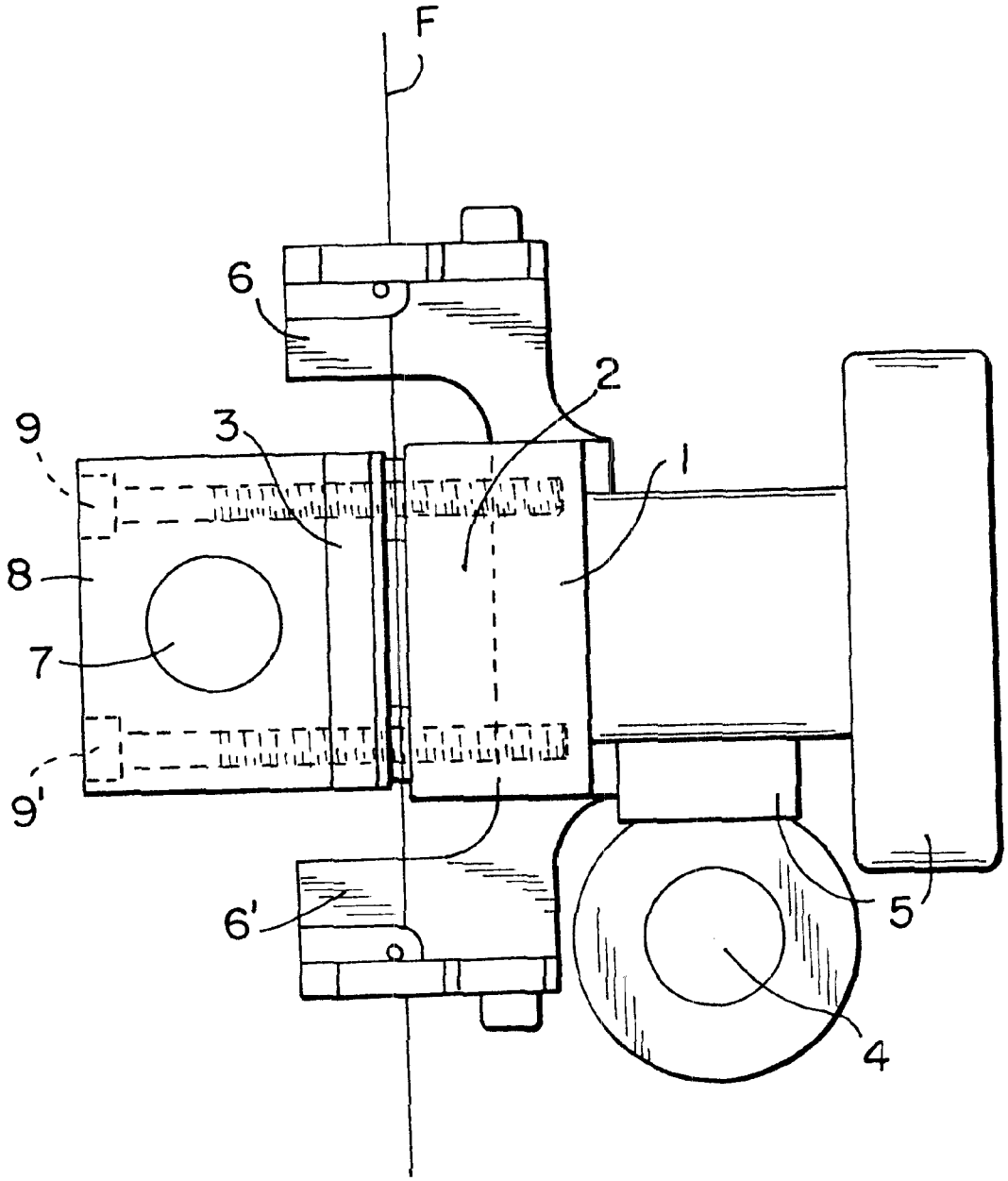

METHOD AND APPARATUS FOR THE PRODUCTION OF INDUSTRIAL FILAMENT YARNS BY SWIRLING AND A POLYESTER FILAMENT YARN

This application is a divisional of 09/463,936 filed Feb. 2, 2000 now U.S. Pat. No. 6,340,525.

The invention relates to a method for the production of industrial filament yarns by swirling a polyester multifilament at increased temperature, under a thread traction force of less than 140 cN, in an air-loaded swirl nozzle consisting of a nozzle body with a perforated plate and a baffle plate, and also to an apparatus for carrying out the method and to an industrial filament yarn.

Multifilament yarns are swirled during the spinning process, in order to obtain an intertwining of the individual filament fibrils and avoid spreading of the threads during further processing. Intertwining is carried out at particular points, and makes it possible to have improved cohesion of the individual filaments in the composite fibril structure and a greater capacity of the yarn for further processing.

Methods for the intertwining of the multifilament yarns are known, knotting taking place in a swirl duct or between two plates by means of an air jet. The number of knots can be controlled both via the pressure and via the velocity of the swirling air.

During the melt-extrusion of the polymers in the spinning process, oligomers always form and may be deposited from the surface of the multifilament yarn onto the cold baffle plate of the swirl nozzles due to the blowing action. These hard, often crust-like deposits may cause blockages in the air supply and in the takeup ducts and also fibril damage and may produce inadequate, unstable and irregularly arranged knots.

Industrial filament yarns made of polyester, in particular those which, in terms of the production method, are characterized by a low winding thread traction force of less than 100 cN, have a particularly strong tendency, in an overall linear density range of 500 to 2000 dtex, to form deposits in the swirl nozzle. By means of the known cold-air swirling, as described, for example, in EP-A-0,148,402, a commercially available open swirl nozzle with perforated plate and baffle plate can be kept in operation for up to a maximum of 24 hours. After that, the nozzle has to be cleaned mechanically and chemically in a complicated procedure.

In order to prolong the nozzle service life and achieve better knotting, knot distribution and swirling stability, hot swirling air has been used for producing such multifilament yarns. In this so-called hot-air swirling, cold compressed air is heated to about 290° C. by an air heater installed in the compressed-air system. Improvements have been achieved, but they are unsatisfactory, particularly because of the irregular knot arrangement and the high energy consumption. Another disadvantage of hot-air swirling is that a complicated regulating system casts doubt on the viability of such a method.

The object of the invention is to provide a simplified method which makes it possible to have a better knot distribution and allows a-prolonged nozzle service life.

Another object is to make available a swirl apparatus which reduces the energy consumption of the method during swirling.

Yet another object is to make available an industrial yarn which is better suited to weaving use. Weaving use refers, above all, to fabrics for tents, blankets, building membranes, awnings, projection screens and geotextiles which, as a rule, receive a coating.

The object is achieved, according to the invention, in that the heat is directly transmitted to the polyester multifilament and the air is directly transmitted, via the nozzle body, to a highly heat-conductive metal block which is connected directly to the baffle plate and in which a bore is provided for receiving a heating body. Improved spreading and knot distribution and also an enormous saving of energy of 85% are thereby achieved. The swirl nozzle, which is a cold point in the spinning process, is eliminated.

It is expedient to heat the baffle plate to a constant temperature of between 150 and 180° C., in particular 150° to 170° C., preferably 160° C. A temperature of below 150° C. has the disadvantage of an increase in the deposits; the swirling properties do not improve any further at a temperature of more than 180° C.

A swirl pressure of between 1.5 to 3.0 bar, in particular 1.8 or 2.8 bar, has proved expedient. A pressure of below 1.5 bar and above 3.0 bar has an adverse influence on optimum knotting. Either too low or too high a number of knots per meter is obtained.

The apparatus for carrying out the method consists of a swirl nozzle with a nozzle body, a perforated plate and a baffle plate. The baffle plate is expediently directly connected, flush, to a highly heat-conductive metal block, for example made of aluminum, in which a bore is provided for receiving a heating body. Electric resistance heating arrangements or any other space-saving heating arrangements are suitable as the heating body. What is essential is the direct contact between the baffle plate and the metal block.

A polyester filament yarn produced by the method according to the invention, having a winding thread traction force of less than 140 cN, in particular less than 100 cN, and with an overall linear density of 500–2000 dtex, has, in addition to a strength of at least 70 cN/tex, along with a breaking elongation of less than 24%, an increased knot resistance of greater than 80% and a distance between 2 knots of greater than 4.0 cm. The polyester filament yarn is pre-eminently suitable for the production of coated fabrics for industrial purposes.

The method according to the invention will be explained with reference to a drawing in which:

FIG. 1 shows a side view of a swirl nozzle according to the invention.

In the single FIG. 1, a nozzle body is designated by the reference symbol 1. The nozzle body 1 is connected via a perforated plate 2 to a baffle plate 3. A compressed-air line 4 is attached to the nozzle body 1 via a holding device 5. Between the perforated plate 2 and the baffle plate 3 is provided a gap which ensures that a thread F passes from a thread guide 6 to a thread guide 6'. A metal body 8 is provided, flush, on the baffle plate 3 and is fastened to the perforated plate 2 by means of assembly screws 9, 9'. The metal body 8 is provided with a bore 7 for receiving a heating body.

The functioning of the apparatus is explained in the exemplary embodiments.

Exemplary Embodiments 1

Linear density: dtex 1100f192; winding force 60 cN

The nozzle described according to FIG. 1 was loaded in a known way, via the compressed-air line 4, with commercially available cold compressed air at 1.8 bar. It was possible to maintain a constant temperature level of 160° C. at the baffle plate 3 for 80 hours by means of the heating body with a heating power of 50 W/50 V. Table 1 shows the results obtained, as compared with the known hot-air swirling.

TABLE 1

| Variant | Type of swirling | Time span (h) | Swirling (kn/m) | Swirling stability (%) |
|---|---|---|---|---|
| Test | Hot nozzle | after 2 h | 12.5 | |
| 1 | Hot nozzle | 24 h | 12.0 | 85.8 |
| 2 | Hot nozzle | 48 h | 11.5 | 93.9 |
| 3 | Hot nozzle | 72 h | 12.1 | 84.3 |
| 4 | Hot nozzle | 80 h | 12.2 | 84.4 |
| Average values 1–4 | Hot nozzle | after 80 h | 12.1 | 87.1 |
| Comparison | Hot air | after 96 h | 12.8 | 78.9 |

The table has the following meanings:

h: hours kn/m: number of knots per 1 m of thread, average value from 50 measured values per package, measured by the pinprick method.

Swirling stability=number of knots per 1 m of thread, measured by the pinprick method, under a dynamic stress of 0.5 cN/dtex and with 1000 load changes per minute.

It is clear from the Table that, after a period of use of 80 hours, a swirling of 12.1 knots/m (desired value: 12.0±1.5), with a spread of 0.36 and a swirling stability of 87.1%, is achieved.

Exemplary Embodiments 2

Linear density: dtex 1100f192, winding force 140 cN

The swirl nozzle according to the invention was used for 96 hours with a baffle plate temperature of 160° C. The standard air pressure of 2.8 bar corresponds to that for hot-air swirling.

Table 2 shows the results obtained, as compared with the known hot-air swirling.

Dt: Breaking elongation under maximum traction force in % kn/m: Number of knots per 1 m of thread, average value from 50 measured values per package, measured by the pinprick method coh: Coherent length, distance between two knots in cm s: Spread indicates the coherent length spread, swirling stability: Number of knots per 1 m of thread, measured by the pinprick method, under a dynamic stress of 0.5 cN/tex and with 1000 load changes per minute.

In a comparison between the prior art and the hot nozzle, a swirling of 11.3 and 10.2 kn/m, a coherent length of 7.8 and 8.8 cm, with a spread of 3.2 and 3.6, and a swirling stability of 86.7 and 83.8 were achieved respectively. The serimetric properties and thread cleanliness remained unchanged.

Energy Consumption

Hot-air swirling: 1.6 kWh

Hot-nozzle swirling: 0.24 kWh

Energy saving: 1.576 kWh or about 85%

As compared with the known hot-air swirling, hot-nozzle swirling results, over the same period of use of the nozzle, in an equally good swirl value, good knot resistance and substantially better knot distribution. The shortest distance between 2 knots increased by at least about 15% from 3.4 to 4 cm. The serimetric properties and thread cleanliness remained unchanged.

The method according to the invention is particularly suitable for the production of high-strength industrial yarn for fabrics for tents, blankets and geotextiles which, as a rule, are coated.

What is claimed is:

1. Polyester filament yarn with an overall linear density of 500–2000 dtex, characterized by a strength of at least 70 cN/tex along with a breaking elongation of less than 24%, a knot resistance of greater than 80% and a distance between 2 knots of greater than 4.0 cm.

TABLE 2

| Time h | Type of swirling | Nozzle temperature ° C. | Ft cN/tex | Dt % | ThS % | kn/m number | Co. cm | s | Minimum distance cm | Resistance (%) |
|---|---|---|---|---|---|---|---|---|---|---|
| Comparison | Hot air | Cold | 72.0 | 22.5 | 6.5 | 11.3 | 7.8 | 3.2 | 3.4 | 86.1 |
| After 2 h | Hot nozzle | 160 | 71.7 | 22.6 | 6.4 | 10.8 | 8.3 | 3.1 | 3.9 | 86.8 |
| After 24 h | Hot nozzle | 160 | 71.9 | 22.8 | 6.5 | 11.6 | 7.6 | 3.6 | 3.8 | 82.2 |
| After 48 h | Hot nozzle | 160 | 71.4 | 22.4 | 7.0 | 8.6 | 11.4 | 4.5 | 4.6 | 84.0 |
| After 72 h | Hot nozzle | 160 | 71.7 | 22.7 | 6.8 | 10.7 | 8.4 | 3.3 | 4.2 | 83.5 |
| After 96 h | Hot nozzle | 160 | 72.1 | 22.5 | 6.5 | 10.5 | 8.6 | 3.5 | 3.7 | 80.0 |
| Average values | Hot nozzle | 160 | 71.8 | 22.6 | 6.6 | 10.2 | 8.8 | 3.6 | 4.0 | 83.3 |

Ft: Tearing strength in cN/tex

* * * * *